US007401958B2

(12) United States Patent
Okada

(10) Patent No.: US 7,401,958 B2
(45) Date of Patent: Jul. 22, 2008

(54) VEHICLE HEADLAMP

(75) Inventor: Noriko Okada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/849,610

(22) Filed: Sep. 4, 2007

(65) Prior Publication Data

US 2008/0055920 A1 Mar. 6, 2008

(30) Foreign Application Priority Data

Sep. 4, 2006 (JP) ..... 2006-238582

(51) Int. Cl.
*F21V 7/00* (2006.01)

(52) U.S. Cl. ..... 362/517; 362/538; 362/520; 362/346

(58) Field of Classification Search ..... 362/507, 362/516, 517, 518, 520, 521, 538, 539, 346
See application file for complete search history.

(56) References Cited

U.S. PATENT DOCUMENTS 6,994,460 B2 * 2/2006 Yamamura ..... 362/539
7,128,455 B2 * 10/2006 Yamamura ..... 362/539
7,186,009 B2 * 3/2007 Yamamura et al. ..... 362/517
7,193,358 B2 * 3/2007 Yamada et al. ..... 313/502
2005/0117363 A1 * 6/2005 Yamamura et al. ..... 362/518
2006/0209556 A1 * 9/2006 Tajima et al. ..... 362/516
2006/0239022 A1 * 10/2006 Inaba et al. ..... 362/538

FOREIGN PATENT DOCUMENTS

JP 2001229715 A 8/2001

* cited by examiner

*Primary Examiner*—Ali Alavi
(74) *Attorney, Agent, or Firm*—Sughrue Mion, PLLC

(57) ABSTRACT

A projector-type vehicle headlamp includes a light source which is a line light source extending in a width direction of a vehicle, a reflector, a first auxiliary reflector disposed below the reflector, and a second auxiliary reflector disposed on a front side of the first auxiliary reflector. A sectional shape of a reflecting surface of the first auxiliary reflector taken along a vertical plane that is parallel to an optical axis is a shape of a parabola having an axis line downwardly extending in a forward direction a predetermined downward inclination angle with respect to the optical axis. A sectional shape of a reflecting surface of a second auxiliary reflector taken along the vertical plane is a straight line downwardly extending in a forward direction at a downward inclination angle which is smaller than the predetermined downward inclination angle.

12 Claims, 11 Drawing Sheets

VEHICLE HEADLAMP

The present invention claims priority from Japanese Patent Application No. 2006-238582 filed on Sep. 4, 2006, the entire content of which is incorporated herein by reference.

FIELD OF THE INVENTION

The present invention relates to a projector-type vehicle headlamp. More specifically, the present invention relates to a vehicle headlamp which forms a low beam light distribution pattern.

DESCRIPTION OF THE RELATED ART

Generally, in a projector-type vehicle headlamp, a projection lens is disposed on an optical axis extending in a longitudinal direction of the vehicle and a light source is provided behind a rear focal point thereof, and a light emitted from the light source is reflected by a reflector close to the optical axis. In a case of a vehicle headlamp for a low beam, a part of the light reflected by the reflector is shielded to form a cutoff line of a low beam light distribution pattern by means of a shade disposed such that an upper edge is positioned in the vicinity of the rear focal point of the projection lens.

JP-A-2001-229715 discloses a projector-type vehicle headlamp in which a light source is a line light source extending in a width direction of a vehicle. Specifically, FIG. 5 of JP-A-2001-229715 shows a structure in which a first auxiliary reflector which reflects a light emitted from the light source in a downward direction and a second auxiliary reflector which reflects the light reflected by the first auxiliary reflector in a forward direction are provided separately from the reflector.

When a line light source extending the width direction of the vehicle is employed as a light source of the projector-type vehicle headlamp, it is possible to easily obtain a structure of a lamp in which a light source bulb is inserted and fixed to a reflector from a side. Consequently, the lamp can be downsized by reducing a size of the lamp in a front-and-rear direction.

Moreover, when a structure including the first and second auxiliary reflectors is employed, it is possible to increase a luminous flux utilization ratio to the light emitted from the light source, thereby maintaining a sufficient brightness of a low beam light distribution pattern.

However, in the vehicle headlamp disclosed in FIG. 5 of JP-A-2001-229715, a reflecting surface of the first auxiliary reflector is formed in a shape of an ellipsoid of revolution in which a point in the vicinity of the light source is set to be a first focal point and a point positioned therebelow is set to be a second focal point, and a reflecting surface of the second auxiliary reflector is formed in a shape of a paraboloid of revolution in which the second focal point is set to be a focal point. For this reason, there are the following problems.

More specifically, in the vehicle headlamp, a light source image formed in the second focal point of the ellipsoid of revolution is set to be a false light source to control a reflected light through the second auxiliary reflector. However, a shape of the false light source is entirely different from that of an original line light source. For this reason, there is a problem in that the control of the reflected light cannot be carried out finely.

SUMMARY OF INVENTION

An aspect of the invention provides a projector-type vehicle headlamp operable to form a bright low beam light distribution pattern with high precision, while reducing a size of the lamp in a front-and-rear direction.

According to an exemplary embodiment of the invention, a vehicle headlamp includes:

a projection lens disposed on an optical axis extending in a longitudinal direction of a vehicle;

a light source disposed on a rear side of a rear focal point of the projection lens;

a reflector which forwardly reflects a light emitted from the light source toward the optical axis;

a shade disposed such that an upper edge of the shade is positioned in the vicinity of the optical axis near the rear focal point, wherein the shade shields a part of the light reflected by the reflector, and forms a cutoff line of a low beam light distribution pattern;

a first auxiliary reflector disposed below the reflector, and downwardly reflects the light emitted from the light source in a forward direction; and a second auxiliary reflector disposed on a front side of the first auxiliary reflector, and forwardly reflects the light reflected by the first auxiliary reflector.

The light source is a line light source extending in a width direction of the vehicle. A sectional shape of a reflecting surface of the first auxiliary reflector taken along a vertical plane that is parallel to the optical axis is a shape of a parabola, the parabola having a focal point in the vicinity of the light source and an axis line downwardly extending in the forward direction at a predetermined downward inclination angle with respect to the optical axis. A sectional shape of a reflecting surface of the second auxiliary reflector taken along the vertical plane is a shape of a substantially straight line downwardly extending in the forward direction at a downward inclination angle which is smaller than the predetermined downward inclination angle. The light emitted from the light source and reflected by the first auxiliary reflector and the second auxiliary reflector is forwardly irradiated as a diffusion light which is diffused in a horizontal direction.

A specific structure of the light source is not particularly restricted as long as the light source is a line light source that extends in a width direction of a vehicle. For example, the light source may be a discharging light emitting portion of a discharge bulb or a filament of a halogen bulb. Moreover, the light source may be positioned either on the optical axis or out of the optical axis.

Sectional shapes of the first auxiliary reflector and the second auxiliary reflector taken along a vertical plane which is orthogonal to the optical axis is not particularly restricted as long as the light emitted from the light source is forwardly irradiated as the diffusion light which is diffused in a horizontal direction via a combination of the first auxiliary reflector and the second auxiliary reflector. In that case, as a specific example of the combination of the first and second auxiliary reflectors for "forwardly irradiating the light emitted from the light source as the diffusion light which is diffused in the horizontal direction", it is possible to employ a combination in which the reflecting surface of the first auxiliary reflector is formed in a shape of a paraboloid of revolution and that of the second auxiliary reflector is an upward convex curved surface or a combination in which the reflecting surface of the first auxiliary reflector is formed in a shape of a parabolic cylinder and that of the second auxiliary reflector is a flat surface.

A specific value of the downward inclination angle of the reflecting surface of the second auxiliary reflector is not particularly restricted as long as a sectional shape of the reflecting surface of the second auxiliary reflector taken along a vertical plane which is parallel to the optical axis is set to be an almost straight line downwardly extending in a forward direction at a downward inclination angle which is smaller than the predetermined downward inclination angle with respect to the optical axis.

DETAILED DESCRIPTION

Hereinafter, exemplary embodiments of the invention will be explained with reference to the drawings. The following exemplary embodiments do not limit the scope of the invention.

Figure 1:
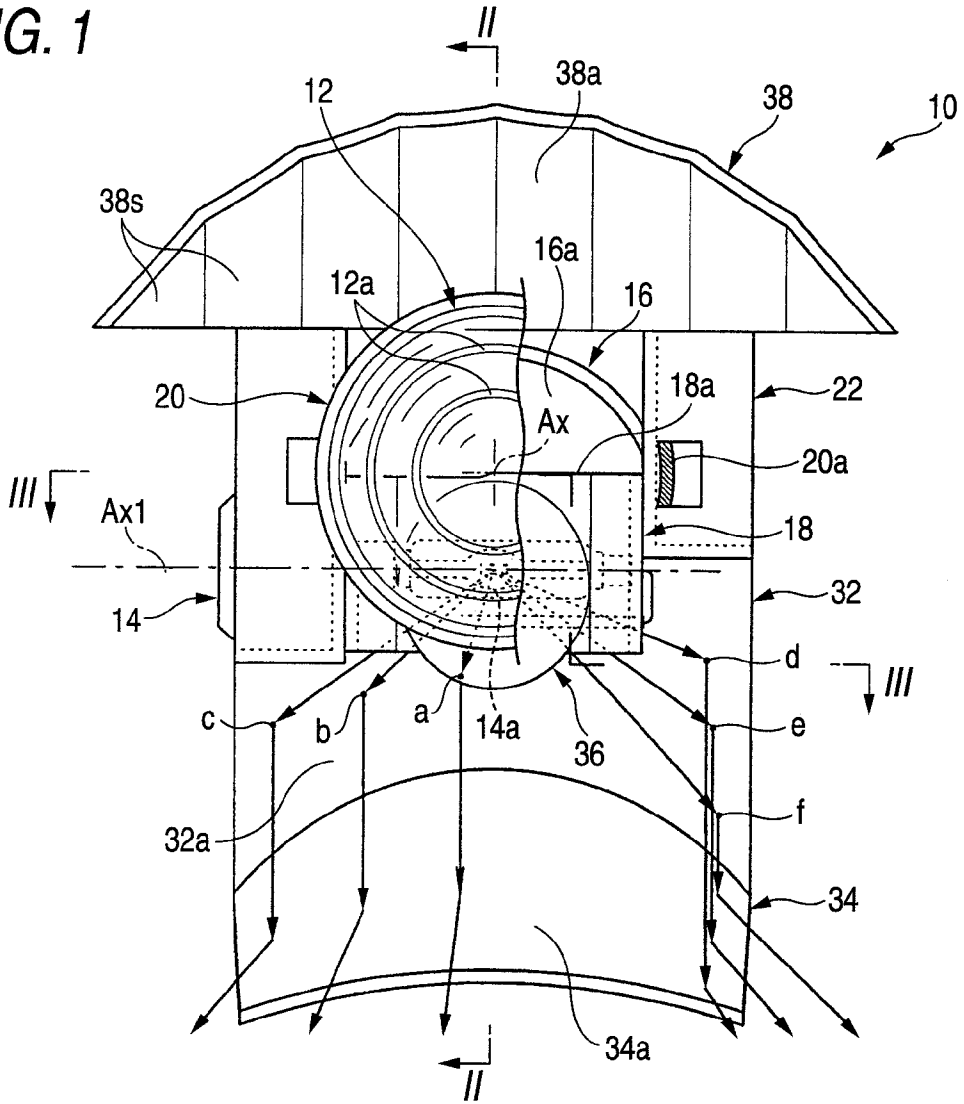
FIG. 1 is a front view showing a vehicle headlamp according to a first exemplary embodiment of the invention.
Figure 2:
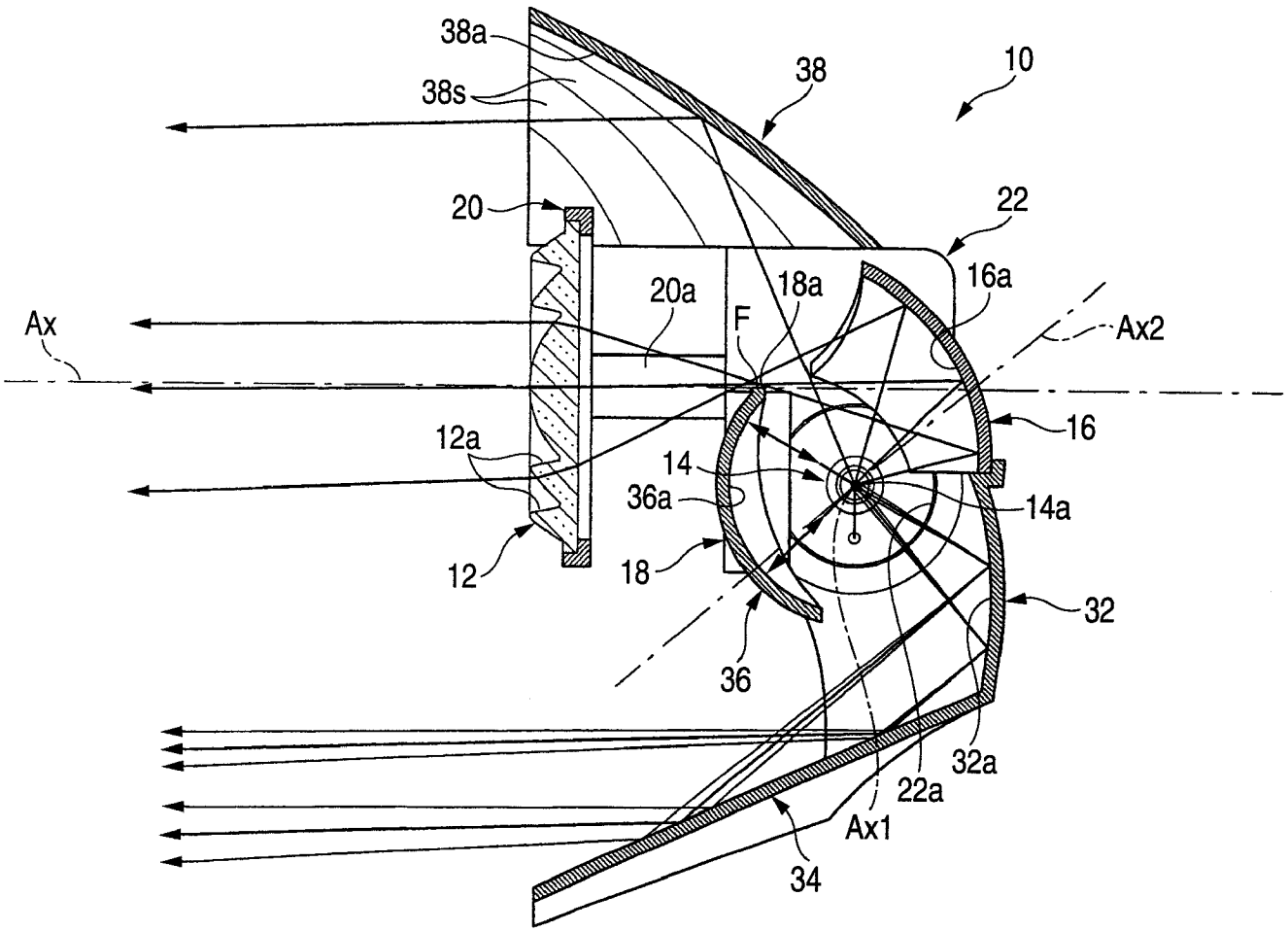
FIG. 2 is a sectional view taken along a II-II line in FIG. 1.
Figure 3:
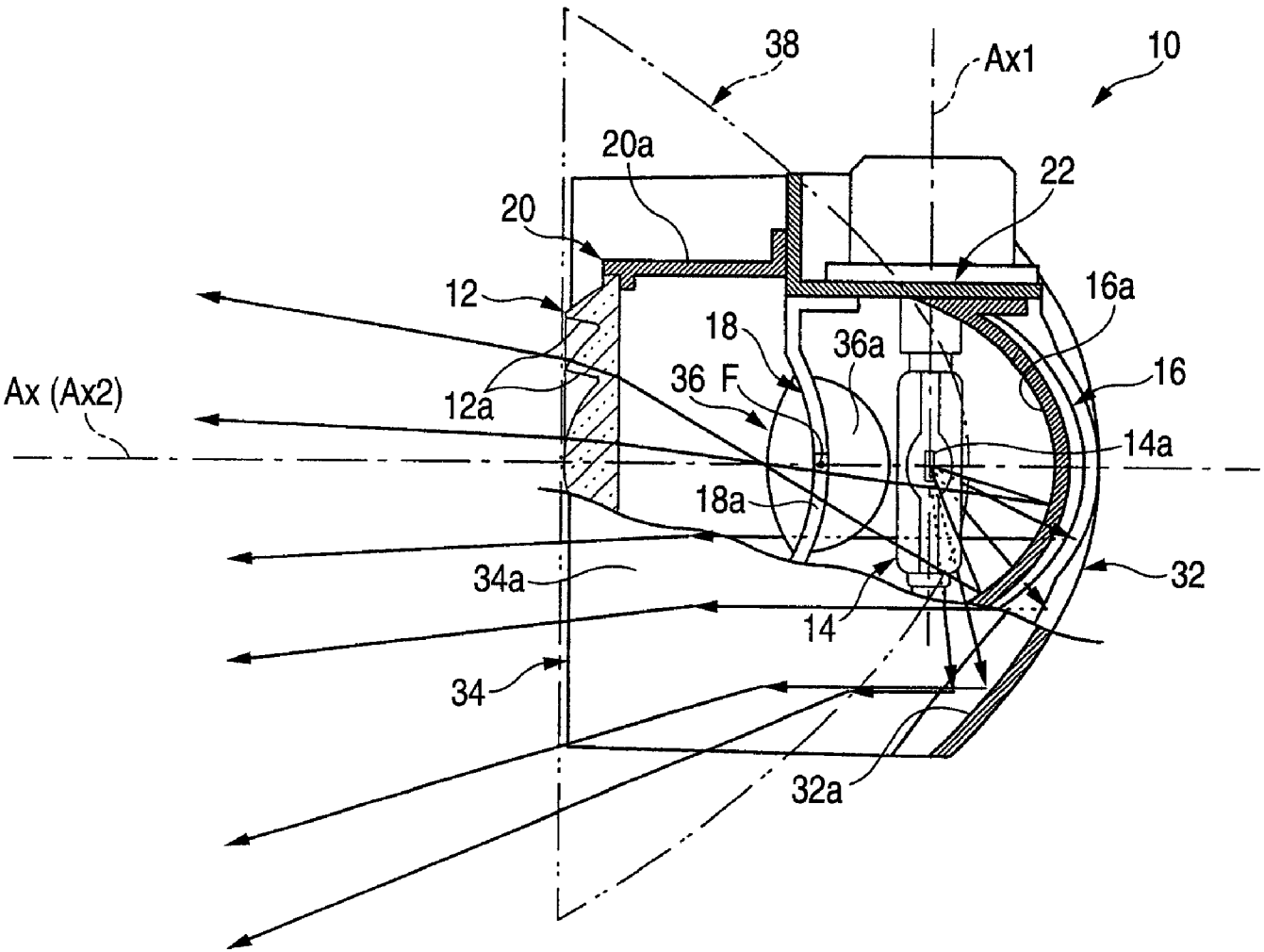
FIG. 3 is a sectional view taken along a III-III line in FIG. 1.

As shown in the FIGS. 1 to 3, a vehicle headlamp 10 according to a first exemplary embodiment is of a projector type for irradiating a light to form a low beam light distribution pattern, and is used in an incorporating state in a lamp body (not shown) so as to freely regulate an optical axis.

The vehicle headlamp 10 includes a projection lens 12, a light source bulb 14, a reflector 16, a shade 18, a lens holder 20, a bracket 22, a first auxiliary reflector 32, a second auxiliary reflector 34, a third auxiliary reflector 36 and a fourth auxiliary reflector 38, and has an optical axis Ax extended in a longitudinal direction of the vehicle. The vehicle headlamp 10 is disposed in a state in which the optical axis Ax is extending in a downward direction by approximately 0.5 to 0.6 degree with respect to the longitudinal direction of the vehicle.

The projection lens 12 is disposed on the optical axis Ax, and projects an image on a focal plane including a rear focal point F as an inverted image toward a vertical virtual screen disposed ahead of a lamp. The projection lens 12 of the first exemplary embodiment is a Fresnel lens formed of a synthetic resin in which a forward surface in a plano-convex aspherical lens having a forward surface to be a convex surface and a rear surface to be a plane is formed like a step of a concentric circle. An inclination angle of each annular step portion 12*a* is set to be approximately 10 to 15 degrees (for example, 12 degrees). The projection lens 12 is supported by the annular lens holder 20, and the lens holder 20 is fixed to the bracket 22 at rear ends of a pair of left and right leg portions 20*a* extended rearward from both side portions thereof.

The light source bulb 14 is a discharge bulb such as a metal halide bulb in which a discharging light emitting portion serves as a light source 14*a*, and the light source 14*a* is a line light source extended along a bulb center axis Ax1. The light source bulb 14 is inserted and fixed into a bulb inserting hole 22*a* of the bracket 22 from a right side (a left side seen from a front of the lamp and so forth) on a rear side of the rear focal point F of the projection lens 12 below the optical axis Ax. The insertion and fixation is carried out so as to place a center of the light source 14*a* (that is, a central position between ignition electrodes on the bulb center axis Ax1) under the optical axis Ax in a state in which the bulb center axis Ax1 is set to be extended in a horizontal direction in a vertical plane which is orthogonal to the optical axis Ax (that is, a state in which the bulb center axis Ax1 is set to be extended in a width direction of a vehicle).

The reflector 16 is disposed to cover the light source 14*a* from an upper-rear side and is fixed to the bracket 22 in both side edge portions thereof. The reflector 16 has a reflecting surface 16*a* for reflecting a light emitted from the light source 14*a* close to the optical axis Ax in a forward direction. In the reflecting surface 16*a*, a sectional shape including a straight light connecting a center of the light source 14*a* and the rear focal point F of the projection lens 12 is set to take an elliptical shape. An eccentricity of the elliptical sectional shape is set to be gradually increased from a vertical section toward a section which is inclined to both of left and right sides. Thus, as shown in FIGS. 2 and 3, the light emitted from the light source 14*a* and reflected by the reflecting surface 16*a* is almost converged in the vicinity of the rear focal point F in the vertical section, and a converging position thereof is moved forward in a horizontal section thereof.

The shade 18 is disposed between the projection lens 12 and the reflector 16 and is fixed to the bracket 22 in both side edge portions thereof. The shade 18 is formed to take a shape of an almost circular arc along the rear focal plane of the projection lens 12 such that an upper edge 18*a* passes through the rear focal point F of the projection lens 12. Consequently, the shade 18 shields a part of the light reflected by the reflecting surface 16*a* of the reflector 16 and removes most of an upward light emitted from the projection lens 12 in a forward direction. In that case, the upper edge 18*a* of the shade 18 is formed such that a region on a left side of the optical axis Ax extends horizontally in a leftward direction from the optical axis Ax, and such that a region on a right side of the optical axis Ax slightly extends obliquely downward in a rightward direction from the optical axis Ax (for example, downward by 15 degrees) and then extends horizontally in the rightward direction.

The first auxiliary reflector 32 is disposed below the reflector 16, and downwardly reflects the light emitted from the light source 14*a* in a forward direction. A sectional shape of a reflecting surface 32*a* of the first auxiliary reflector 32 taken along a vertical plane which is parallel to the optical axis Ax is set to be identical to a shape of a parabola having a focal point at a light emitting center of the light source 14*a* and a center axis being an axis line Ax2 downwardly extending in a forward direction at a predetermined downward inclination angle with respect to the optical axis Ax (more specifically, approximately 40 degrees, for example). The reflecting surface 32*a* is formed in a shape of a paraboloid of revolution in which the axis line Ax2 is set to be a center axis. The first auxiliary reflector 32 and the bracket 22 are formed in a one-piece structure.

The second auxiliary reflector 34 is disposed on a front side of the first auxiliary reflector 32, and forwardly reflects the light emitted from the light source 14*a* and reflected by the first auxiliary reflector 32. The second auxiliary reflector 34 and the first auxiliary reflector 32 are formed in a one-piece structure.

A sectional shape of a reflecting surface 34*a* of the second auxiliary reflector 34 taken along a vertical plane which is parallel to the optical axis Ax is set to be a straight line downwardly extending in a forward direction at a downward inclination angle smaller than the downward inclination angle of the axis line Ax2. A sectional shape of the reflecting surface 34*a* taken along a vertical plane which is orthogonal to the optical axis Ax is set to be an upward convex curve. A curvature of the upward convex curve is set to be gradually increased from a front edge of the reflecting surface 34*a* to a rear edge thereof, thereby forming an almost conical surface as a whole.

More specifically, in the reflecting surface 34*a* of the second auxiliary reflector 34, the downward inclination angle is set to be a little greater than a half of the downward inclination angle of the axis line Ax2 in the vertical plane including the optical axis Ax, and the reflecting surface 34*a* is formed such that the downward inclination angle is gradually reduced apart from the vertical plane including the optical axis Ax in a horizontal direction. A light incident as a parallel light from the first auxiliary reflector 32 is irradiated forward as a diffusion light which is diffused in the horizontal direction through a space provided on a lower side of the projection lens 12 by means of the second auxiliary reflector 34.

The third auxiliary reflector 36 is disposed in front of the light source 14*a* in order to effectively utilize a light emitted in a forward direction from the light source 14*a*. A reflecting surface 36*a* of the third auxiliary reflector 36 is a spherical surface in which a center of the light source 14*a* is set to be a center, and reflects the light emitted forward from the light source 14*a* back to a position of the light source 14*a* so that the light becomes incident on the reflector 16 and the first auxiliary reflector 32. The third auxiliary reflector 36 and the shade 18 are formed in a one-piece structure.

The fourth auxiliary reflector 38 is disposed above the shade 18, and reflects a light, which is upwardly emitted from the light source 14*a* in a forward direction and is passed between the reflector 16 and the shade 18, in a forward direction on an upper side of the projection lens 12. A reflecting surface 38*a* of the fourth auxiliary reflector 38 has a reference surface having a shape of a paraboloid of revolution in which the center of the light source 14*a* is set to be a focal point and an axis line extended slightly downward with respect to the optical axis Ax in a forward direction is set to be a central axis, and a plurality of diffuse reflecting portions 38*s* is formed thereon in a form of vertical stripes. The reflecting surface 38*a* of the fourth auxiliary reflector 38 reflects the light emitted from the light source 14*a* slightly downward and diffuses the light in a horizontal direction.

Figure 4:
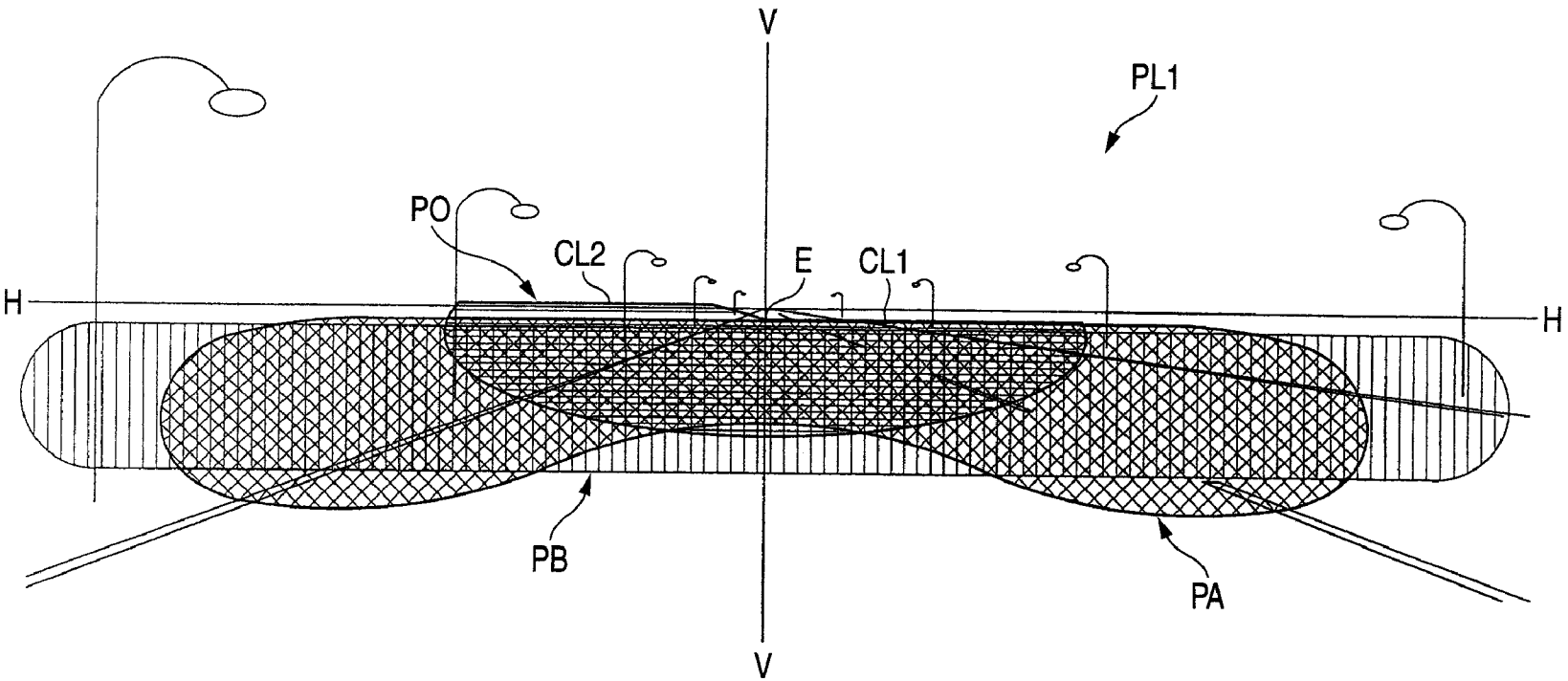
FIG. 4 is a perspective view showing a low beam light distribution pattern formed on a virtual vertical screen disposed 25 m ahead from a lamp by a light irradiated from the vehicle headlamp in a forward direction.

FIG. 4 is a perspective view showing a light distribution pattern PL1 for a low beam which is formed on a virtual vertical screen disposed 25 m ahead of a lamp by a light irradiated forward from the vehicle headlamp 10 according to the first exemplary embodiment.

The light distribution pattern PL1 for a low beam is formed as a synthetic light distribution pattern of a basic light distribution pattern P0 and two auxiliary light distribution patterns PA and PB.

The basic light distribution pattern P0 is a light distribution pattern taking a basic shape of the light distribution pattern PL1 for a low beam and is formed by a light reflected by the reflector 16.

The basic light distribution pattern P0 is a low beam light distribution pattern which has a left light distribution, and has cutoff lines CL1 and CL2 at an upper edge thereof. The cutoff lines CL1 and CL2 are formed as an inverted projection image of the upper edge 18*a* of the shade 18. The cutoff line CL1 on an opposing lane side is formed to be extended horizontally, and the cutoff line CL2 on a self-lane side is formed to be slightly raised obliquely upward from an H-H line (that is, a horizontal line passing through A vanishing point H-V in a front direction of the lamp) at a predetermined angle (for example, 15 degrees) from the cutoff line CL1 on the opposing lane side and to be then extended horizontally.

In the basic light distribution pattern P0, an elbow point E to be an intersection point of the cutoff line CL1 on the opposing lane side and a V-V line (that is, a vertical line passing through H-V) is positioned below H-V at approximately 0.5 to 0.6 degree. The reason is that the optical axis Ax is extending in a downward direction by approximately 0.5 to 0.6 degree with respect to the longitudinal direction of the vehicle.

The basic light distribution pattern P0 is formed as a comparatively small light distribution pattern for the following reason.

More specifically, in the projection lens 12 which is a Fresnel lens, when an angle of emission from the projection lens 12 is increased, a light is easily incident on the annular step portion 12*a* on the surface at the forward side thereof. However, the annular step portion 12*a* is an optically ineffective portion. For this reason, the basic light distribution pattern P0 is set to be a comparatively small light distribution pattern such that the angle of light emission from the projection lens 12 is not increased greatly. Moreover, the projection lens 12 is formed of a synthetic resin. In consideration of the fact that the projection lens 12 might be deformed by heat when the light reflected by the reflector 16 is converged in the vicinity of the projection lens 12, the basic light distribution pattern P0 is set to be a comparatively small light distribution pattern to converge the light reflected by the reflector 16 in a position placed apart from the projection lens 12 in a rearward direction. Consequently, a heat deformation is prevented from being generated.

The auxiliary light distribution pattern PA is additionally formed to reinforce a brightness in the basic light distribution pattern P0 and diffusion regions on both of left and right sides thereof, and is formed by the light emitted from the light source 14*a* which is sequentially reflected by the first auxiliary reflector 32 and the second auxiliary reflector 34 and is diffused and irradiated in a forward direction.

The auxiliary light distribution pattern PA is formed as a horizontal light distribution pattern. The auxiliary light distribution pattern PA has an upper edge extending in a horizontal direction in a position on almost the same level as the cutoff line CL1 on the opposing lane side of the basic light distribution pattern P0, and a lower edge constricted upward in a central part in a horizontal direction. The auxiliary light distribution pattern PA will be described below in detail.

The auxiliary light distribution pattern PB is additionally formed to further reinforce a brightness in the basic light distribution pattern P0 and the auxiliary light distribution pattern PA, and the diffusion regions on both of the left and right sides thereof, and is formed by the light emitted from the light source 14*a* which is reflected by the fourth auxiliary reflector 38 and is diffused and irradiated in a forward direction.

Figure 5A:
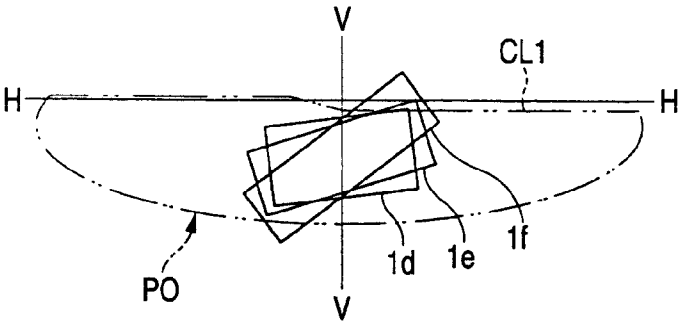
FIGS. 5A to 5C are views for explaining a process for forming an auxiliary light distribution pattern which forms a part of the low beam light distribution pattern by using the virtual vertical screen.
Figure 5B:
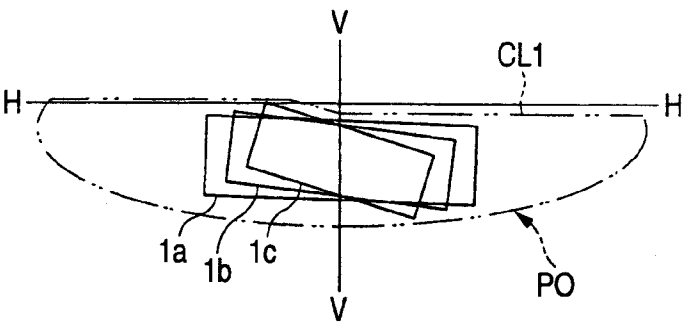
Figure 5C:
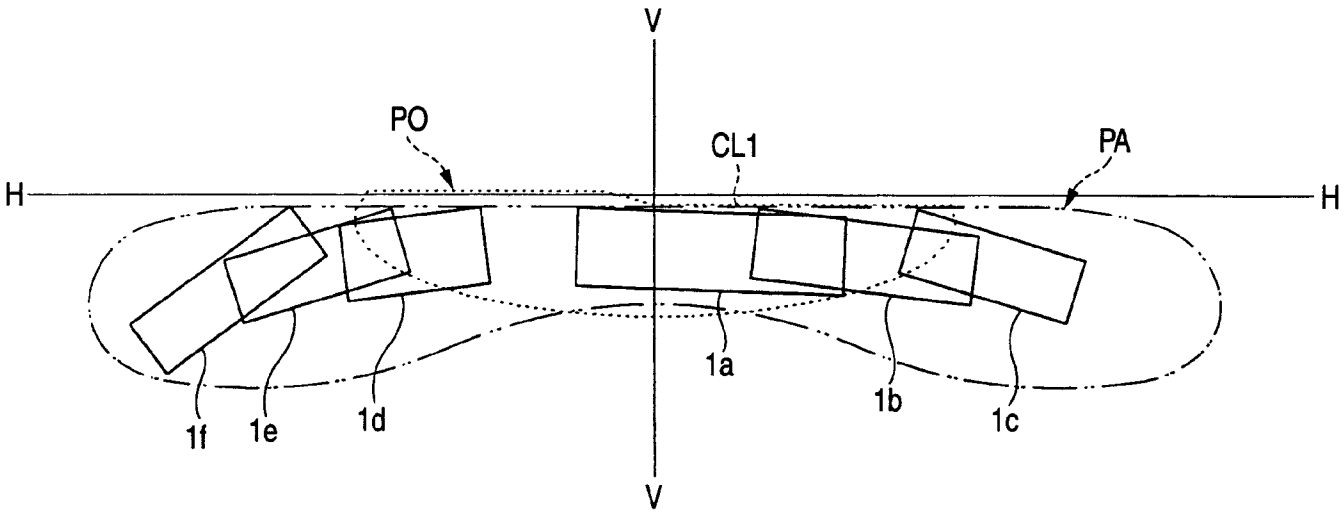

FIGS. 5A to 5C are views for explaining a process for forming the auxiliary light distribution pattern PA by using the virtual vertical screen.

Six light source images Ia, Ib, Ic, Id, Ie and If shown in FIG. 5C are formed by the light which is emitted from the light source 14*a*, and is reflected by six points a, b, c, d, e and f on the reflecting surface 32*a* of the first auxiliary reflector 32 shown in FIG. 1 and is then reflected by the reflecting surface 34*a* of the second auxiliary reflector 34.

If the reflecting surface 34*a* of the second auxiliary reflector 34 is a mirror extending in a horizontal direction with a flat surface while maintaining the shape of the vertical section shown in FIG. 2, the six light source images Ia, Ib, Ic, Id, Ie and If are formed in positions shown in FIGS. 5A and 5B. First of all, description will be given to the six light source images Ia, Ib, Ic, Id, Ie and If formed in the positions shown in FIGS. 5A and 5B.

As shown in FIG. 1, the point "a" is positioned on a right side with respect to the vertical plane including the optical axis Ax and is placed in a close position to the vertical plane. Therefore, the light source image Ia formed by the light reflected through the point "a" is inclined slightly rightward and downward and is extended to be long in an almost horizontal direction as shown in FIG. 5B. As shown in FIG. 1, the point "b" is placed in a position apart from the point "a" rightward and sideward. Therefore, the light source image Ib formed by the light reflected through the point "b" is slightly shorter than the light source image Ia and is inclined slightly rightward and downward as shown in FIG. 5B. As shown in FIG. 1, the point "c" is placed in a position apart from the point "b" rightward and sideward. Therefore, the light source image Ic formed by the light reflected through the point "c" is slightly shorter than the light source image Ib and is inclined slightly rightward and downward as shown in FIG. 5B.

On the other hand, as shown in FIG. 1, the point "e" has a symmetrical positional relationship with the point "c" with respect to the vertical plane including the optical axis Ax. The light source image Ie formed by the light reflected through the point "e" takes a leftward and downward shape in which the light source image Ic is transversely inverted as shown in FIG. 5A. As shown in FIG. 1, the point "d" is placed in a position apart from the point "e" in an upward direction and approaches a plane formed by the axis lines Ax1 and Ax2. Therefore, the light source image Id formed by the light reflected through the point "d" has a smaller leftward and downward inclination angle than the light source image Ie, is slightly shorter than the light source image Ie and has a greater vertical width than the light source image Ie as shown in FIG. 5A. On the other hand, as shown in FIG. 1, the point "f" is placed in a position apart from the point "e" in a downward direction and is considerably separated from the plane formed by the axis lines Ax1 and Ax2. Therefore, the light source image If formed by the light reflected through the point "f" has a greater leftward and downward inclination angle than the light source image Ie, is slightly longer than the light source image Ie and has a smaller vertical width than the light source image Ie.

Actually, the reflecting surface 34*a* of the second auxiliary reflector 34 is an almost conical curved surface as described above. Therefore, As shown in FIG. 5C, the light source images Ia, Ib and Ic are formed in the positions displaced in a rightward direction from the positions shown in FIG. 5B, and the light source images Id, Ie and If are formed in the positions displaced in a leftward direction from the positions shown in FIG. 5A.

In that case, since the light source image Ia is formed by a light reflected in a position in which a rightward and downward inclination angle is small in the reflecting surface 34*a* of the second auxiliary reflector 34, it is formed in a close position to the V-V line in the virtual vertical screen. Since the light source image Ib is formed by a light reflected in a position in which a rightward inclination angle is greater, it is formed in a position displaced in a rightward direction from the light source image Ia in the virtual vertical screen. Since the light source image Ic is formed by a light reflected in a position in which a rightward and downward inclination angle is further greater, it is formed in a position displaced in a rightward direction from the light source image Ib in the virtual vertical screen.

On the other hand, since the reflecting surface 34*a* of the second auxiliary reflector 34 has a symmetrical shape with respect to the vertical plane including the optical axis Ax, the light source image Ie is formed in a symmetrical positional relationship with the light source image Ic with respect to the V-V line in the virtual vertical screen. Since the light source image Id is formed by a light reflected in a position in which a leftward and downward inclination angle on the forward side of the reflecting surface 34*a* is smaller than that in the light source image Ie, it is formed in a closer position to the V-V line than the light source image Ie in the virtual vertical screen. Since the light source image If is formed by a light reflected in a position in which a leftward and downward inclination angle on a rear side of the reflecting surface 34*a* is greater than that in the light source image Ie, it is formed in a more distant position from the V-V line than the light source image Ie in the virtual vertical screen.

As shown in FIG. 5C, each of the light source images Ia, Ib, Ic, Id, Ie and If is displaced somewhat downward from each of the light source images Ia, Ib, Ic, Id, Ie and If shown in FIGS. 5A and 5B, and is formed such that an upper end position thereof is almost coincident with the position of the cutoff line CL1 on the opposing lane side of the basic light distribution pattern P0. The operation is carried out by finely regulating a surface shape of the reflecting surface 34*a* of the second auxiliary reflector 34.

More specifically, as described above, an upward convex curve of the sectional shape taken along a vertical plane which is orthogonal to the optical axis Ax in the reflecting surface 34*a* of the second auxiliary reflector 34 has a curvature set to be gradually increased from the front edge of the reflecting surface 34*a* toward the rear edge thereof and has a variation set to have such a value that the positions of the upper ends of the respective light source images Ia, Ib, Ic, Id, Ie and If are almost coincident with the cutoff line CL1 on the opposing lane side of the basic light distribution pattern P0 (that is, such a value as to approach the cutoff line CL1 on the opposing lane side within a range which does not upwardly get out of the cutoff line CL1). The setting can easily be carried out by a ray tracing calculation of a light reflected from each point in the reflecting surface 34*a* of the second auxiliary reflector 34.

An external shape of the auxiliary light distribution pattern PA is thus formed as an external shape envelope of innumerable light source images formed by the light reflected from each point in the reflecting surface 34*a* of the second auxiliary reflector 34. At this time, each of the light source images is formed such that the position of the upper end is almost coincident with the cutoff line CL1 on the opposing lane side of the basic light distribution pattern P0. Therefore, the upper edge of the auxiliary light distribution pattern PA is extended in an almost horizontal direction in the position on almost the same level as the cutoff line CL1 on the opposing lane side of the basic light distribution pattern P0. Moreover, the light source image extended in the horizontal direction, for example, the light source image Ia is formed in the vicinity of the V-V line and the light source image extended in an inclined direction to the horizontal direction, for example, the light source image If is formed in a position placed apart from the V-V line. Therefore, the lower edge of the auxiliary light distribution pattern PA has the central part in the horizontal direction which is constricted toward an upper side.

As described above in detail, the vehicle headlamp 10 according to the first exemplary embodiment is the projector-type vehicle headlamp 10 which has the shade 18 and the light source 14*a* is a line light source extending the width direction of the vehicle. Therefore, it is possible to easily have a lamp structure in which the light source bulb 14 is inserted and fixed into the reflector 16 from the side thereof. Consequently, the lamp can be downsized by reducing the size of the lamp in a front-and-rear direction.

In the vehicle headlamp 10 according to the first exemplary embodiment, the first auxiliary reflector 32 is disposed below the reflector 16 and downwardly reflects the light emitted from the light source 14*a* in a forward direction. The second auxiliary reflector 34 is disposed on a front side of the first auxiliary reflector 32 and forwardly reflects the light emitted from the light source 14*a* and reflected by the first auxiliary reflector 32. Therefore, the light distribution pattern PL1 for a low beam can be formed as a synthetic light distribution pattern in which the auxiliary light distribution pattern PA formed by the light irradiated through the first and second auxiliary reflectors 32 and 34 is superposed on the basic light distribution pattern P0 formed by the light irradiated through the reflector 16 and the projection lens 12. Consequently, it is possible to enhance a luminous flux utilization ratio to the light emitted from the light source 14*a*, thereby maintaining the brightness of the light distribution pattern PL1 for a low beam sufficiently.

In the vehicle headlamp 10 according to the first exemplary embodiment, the sectional shape of the reflecting surface 32*a* of the first auxiliary reflector 32 taken along the vertical plane which is parallel to the optical axis Ax is formed in a shape of a parabola having a focal point at the center of the light source 14*a* and the axis line Ax2 downwardly extending in a forward direction at a predetermined downward inclination angle with respect to the optical axis Ax. Therefore, the light emitted from the light source 14*a* and reflected by the first auxiliary reflector 32 becomes parallel light which is downwardly directed in a forward direction within the vertical plane. At this time, the light source 14*a*, a line light source extending the width direction of the vehicle, is an almost point light source in the vertical plane which is parallel to the optical axis Ax. Therefore, the light emitted from the light source 14*a* and reflected by the first auxiliary reflector 32 is incident, on the second auxiliary reflector 34, as a parallel light which rarely has spreading in the vertical direction.

The sectional shape of the reflecting surface 34*a* of the second auxiliary reflector 34 taken along the vertical plane is set to be the straight line downwardly extending in a forward direction at a smaller downward inclination angle than the predetermined downward inclination angle. Therefore, the light emitted from the light source 14*a* and reflected by the first auxiliary reflector 32 is regularly reflected by the second auxiliary reflector 34, and is irradiated forward as substantially parallel light which rarely has spreading in the vertical direction.

Accordingly, in the vertical plane which is parallel to the optical axis Ax, the light emitted from the light source 14*a* is changed into the parallel light via the first auxiliary reflector 32 and is regularly reflected by the second auxiliary reflector 34. Consequently, it is possible to finely control the lights reflected by the first and second auxiliary reflectors.

More specifically, it is possible to form the auxiliary light distribution pattern PA along the cutoff line CL1 on the opposing lane side of the basic light distribution pattern P0 by properly setting the downward inclination angle of the reflecting surface of the second auxiliary reflector 34. Because the first and second auxiliary reflectors 32 and 34 are arranged to forwardly irradiate the light emitted from the light source 14*a* as the diffusion light which is diffused in the horizontal direction by their combination, the auxiliary light distribution pattern PA can be formed as a horizontal light distribution pattern.

According to the projector-type vehicle headlamp 10 of the first exemplary embodiment which forms the light distribution pattern PL1 for a low beam, it is possible to reduce the size of the lamp in a front-and-rear direction, and to form the bright light distribution pattern PL1 for a low beam with high precision.

In addition, in the vehicle headlamp 10 according to the first exemplary embodiment, the light emitted forward from the light source 14*a* is reflected back to the position of the light source 14*a* by the third auxiliary reflector 36, and becomes incident on the reflector 16 and the first auxiliary reflector 32. Therefore, it is possible to correspondingly increase the brightness of the basic light distribution pattern P0 and the auxiliary light distribution pattern PA. Consequently, the light distribution pattern PL1 for a low beam can be made brighter.

In the vehicle headlamp 10 according to the first exemplary embodiment, the light, which is upwardly emitted from the light source 14*a* in a forward direction and is passed between the reflector 16 and the shade 18, is reflected in the forward direction on the upper side of the projection lens 12 by the fourth auxiliary reflector 38, and the auxiliary light distribution pattern PB is formed additionally. Therefore, the light distribution pattern PL1 for a low beam can be made still brighter.

In the vehicle headlamp 10 according to the first exemplary embodiment, the projection lens 12 is a Fresnel lens. Therefore, it is possible to reduce the thickness of the projection lens 12. Consequently, it is possible to promote a reduction in the size of the lamp in the front-and-rear direction more greatly. In the case in which the projection lens 12 is a Fresnel lens, the annular step portion 12*a* is an optically ineffective portion. Therefore, it is hard to form the basic light distribution pattern having a large diffusion. In addition, in the projection lens 12 formed of a synthetic resin according to the first exemplary embodiment, it is hard to form the basic light distribution pattern having the large diffusion also in respect of a prevention of a heat deformation. Therefore, it is particularly effective to form the horizontal auxiliary light distribution pattern PA along the cutoff line CL1 on the opposing lane side of the basic light distribution pattern P0. More specifically, the auxiliary light distribution pattern PA is formed such that the upper edge is extended on almost the same level as the cutoff line CL1 on the opposing lane side at both of the left and right sides of the basic light distribution pattern P0. Consequently, it is possible to enhance a distance of visibility on both of the left and right sides of the forward road surface of the vehicle, thereby improving a running safety in a turning operation.

In the vehicle headlamp 10 according to the first exemplary embodiment, the reflecting surface 32*a* of the first auxiliary reflector 32 is formed in a shape of a paraboloid of revolution in which the axis line Ax2 is set to be a central axis, and the sectional shape of the reflecting surface 34*a* of the second auxiliary reflector 34 taken along the vertical plane which is orthogonal to the optical axis Ax is set to be the upward convex curve. Therefore, the light reflected by the first auxiliary reflector 32 can be changed into a parallel light having no spreading in the horizontal direction in addition to the vertical direction, and the parallel light can be reflected as a diffusion light which is diffused in the horizontal direction by the second auxiliary reflector 34. In that case, by setting the curvature of the upward convex curve to have a proper value, it is possible to accurately set a transverse diffusion angle thereof.

In the first exemplary embodiment, particularly, the curvature of the upward convex curve is set to be gradually increased from the front edge of the reflecting surface 34*a* of the second auxiliary reflector 34 toward the rear edge thereof. Therefore, it is possible to obtain the following effects and advantages.

Specifically, the light reflected by the first auxiliary reflector 32 and incident on the vicinal regions of both of the left and right side edges in the vicinity of the rear edge in the reflecting surface 34*a* of the second auxiliary reflector 34 is reflected in the position placed apart from both the vertical plane including the center axis Ax2 of the paraboloid of revolution and the plane formed by the center axis Ax2 of the paraboloid of revolution and the axis line Ax1 of the line light source extending the width direction of the vehicle in the reflecting surface 32*a* of the first auxiliary reflector 32. Therefore, the light source image of the line light source formed by reflecting the reflected light at the second auxiliary reflector 34 again is an oblique image extended in the inclined direction to the horizontal direction, for example, the light source image If shown in FIG. 5C. Therefore, it is possible to turn the oblique image in the direction which is deflected greatly in the horizontal direction with respect to the front direction of the vehicle by increasing the curvature of the convex curve in the vicinal region of the rear edge in the reflecting surface 34*a* of the second auxiliary reflector 34 to reflect the light reflected by the first auxiliary reflector 32 and incident on the vicinal regions of both of the left and right side edges in a direction which is greatly deflected in a horizontal direction with respect to the front direction of the vehicle. Consequently, it is possible to prevent a close region on the forward road surface of the vehicle from being excessively bright.

Next, description will be given to a second exemplary embodiment.

Figure 6:
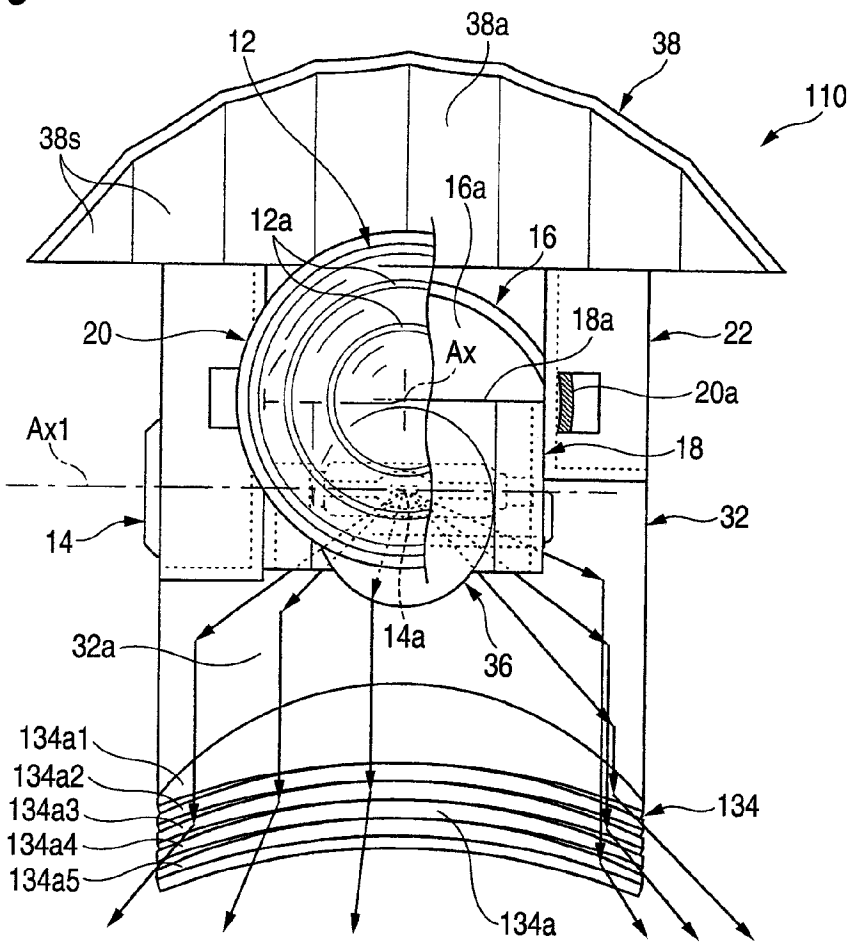
FIG. 6 is a front view illustrating a second exemplary embodiment.
Figure 7:
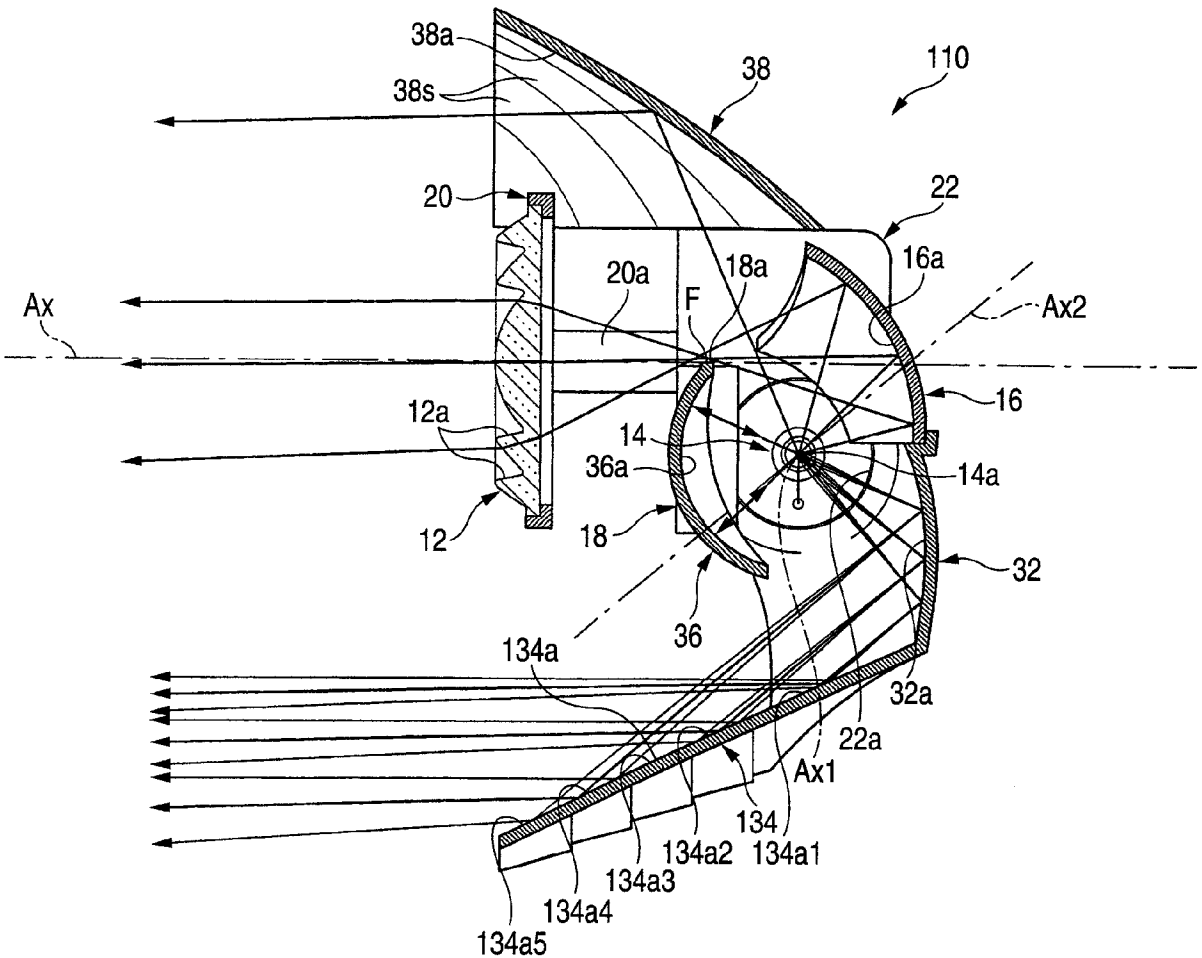
FIG. 7 is a sectional view illustrating the second exemplary embodiment.

FIGS. 6 and 7 illustrate a vehicle headlamp 110 according to the second exemplary embodiment.

As shown in the drawings, the vehicle headlamp 110 according to the second exemplary embodiment has a basic structure which is the same as that of the vehicle headlamp 10 of the first exemplary embodiment. A structure of a second auxiliary reflector 134 is different from that of the second auxiliary reflector 34 of the first exemplary embodiment.

More specifically, the second auxiliary reflector 134 according to the second exemplary embodiment is disposed on a front side of a first auxiliary reflector 32 in the same manner as the second auxiliary reflector 34 of the first exemplary embodiment, and forwardly reflects a light emitted from a light source 14*a* and reflected by the first auxiliary reflector 32. The second auxiliary reflector 134 and the first auxiliary reflector 32 are formed in a one-piece structure.

In the second auxiliary reflector 134, a reflecting surface 134*a* is divided into a plurality of reflecting regions (five reflecting regions according to the second exemplary embodiment) 134*a*1, 134*a*2, 134*a*3, 134*a*4 and 134*a*5 in a front-and-rear direction. Each of the reflecting regions 134*a*2, 134*a*3, 134*a*4 and 134*a*5 is formed in a stripe shape extending in a horizontal direction except for the reflecting region 134*a*1 positioned on a rear end.

In the respective reflecting regions 134*a*1, 134*a*2, 134*a*3, 134*a*4 and 134*a*5, a sectional shape taken along a vertical plane including an optical axis Ax is set to be a straight line downwardly extending in a forward direction at a downward inclination angle which is almost a little greater than a half of a downward inclination angle of an axis line Ax2. In that case, the downward inclination angle is the smallest in the reflecting region 134*a*1 positioned on the rear end and is the greatest in the reflecting region 134*a*5 positioned on a front end. The downward inclination angles in the three reflecting regions 134*a*2, 134*a*3 and 134*a*4 positioned in a middle are set to be gradually increased in order of the reflecting regions 134*a*2, 134*a*3 and 134*a*4 from a rear side. Consequently, the light emitted from the light source 14*a* and reflected by the reflecting surface 134*a* of the second auxiliary reflector 134 has spreading corresponding to a vertical width of the light source 14*a* as shown in FIG. 7. However, a direction of an upper edge of a bundle of rays is caused to be coincident with a parallel direction with the optical axis Ax.

In the respective reflecting regions 134*a*1, 134*a*2, 134*a*3, 134*a*4 and 134*a*5, all of sectional shapes taken along a vertical plane which is orthogonal to the optical axis Ax are set to be upward convex curves. A curvature of the upward convex curve is set to be gradually increased from a front edge toward a rear edge for each of the reflecting regions 134*a*1, 134*a*2, 134*a*3, 134*a*4 and 134*a*5.

Figure 8:
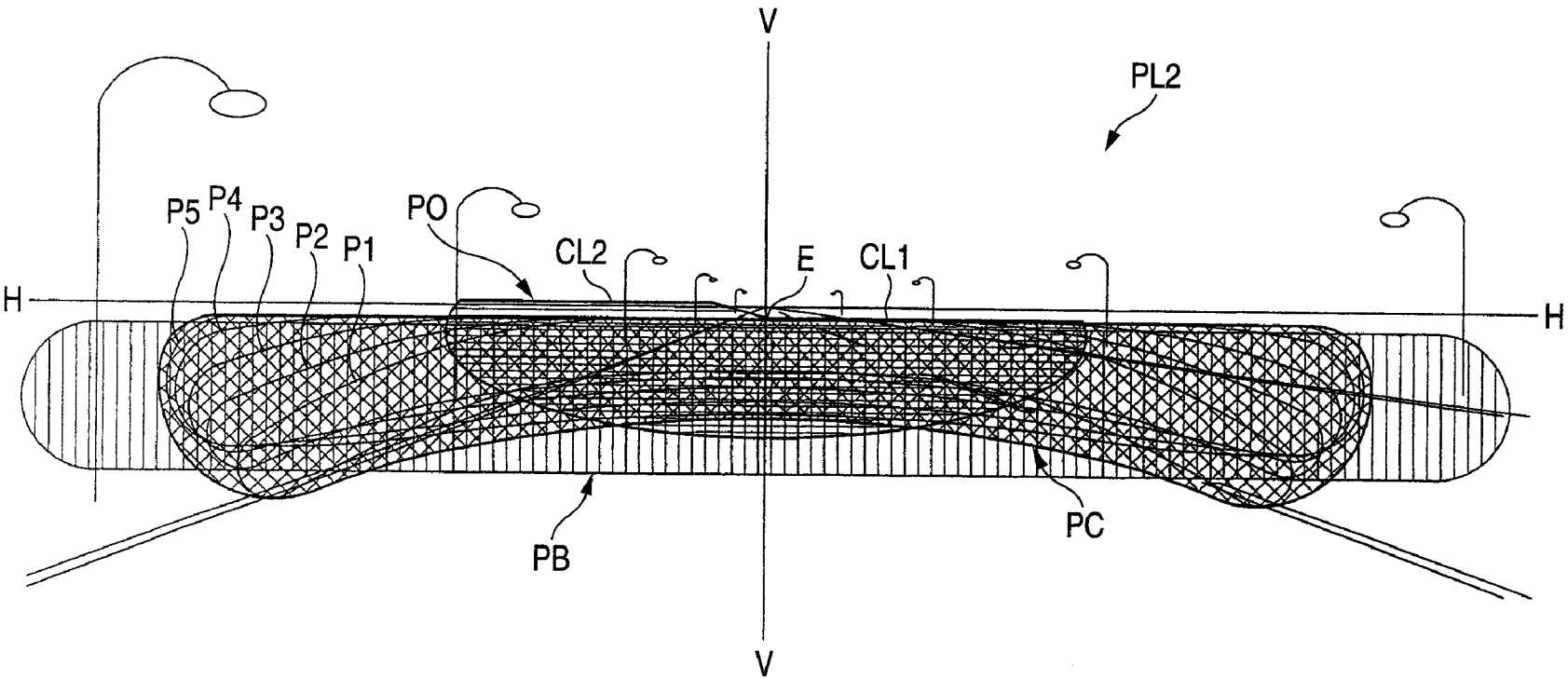
FIG. 8 is a perspective view showing a low beam light distribution pattern formed on the virtual vertical screen by a light irradiated from a vehicle headlamp according to the second exemplary embodiment in a forward direction.

FIG. 8 is a perspective view showing a light distribution pattern PL2 for a low beam which is formed on a virtual vertical screen disposed 25 m ahead of a lamp by a light irradiated forward from the vehicle headlamp 110 according to the second exemplary embodiment.

The light distribution pattern PL2 for a low beam is formed as a synthetic light distribution pattern of a basic light distribution pattern P0 and two auxiliary light distribution patterns PB and PC.

The basic light distribution pattern P0 and the auxiliary light distribution pattern PB are entirely the same as those of the first exemplary embodiment.

The auxiliary light distribution pattern PC is formed by the light emitted from the light source 14*a* and reflected sequentially by the first auxiliary reflector 32 and the second auxiliary reflector 134 and diffused and irradiated in a forward direction and corresponds to the auxiliary light distribution pattern PA of the first exemplary embodiment.

In the same manner as the auxiliary light distribution pattern PA of the first exemplary embodiment, the auxiliary light distribution pattern PC is formed as a horizontal light distribution pattern and has an upper edge extended in an almost horizontal direction in a position on almost the same level as a cutoff line CL1 on an opposing lane side of the basic light distribution pattern P0 and a lower edge constricted toward an upper side in a central part in a horizontal direction.

The auxiliary light distribution pattern PC is formed as a synthetic light distribution pattern in which five horizontal light distribution patterns P1, P2, P3, P4 and P5 are superposed. The five horizontal light distribution patterns P1, P2, P3, P4 and P5 are formed by lights reflected by the five reflecting regions 134*a*1, 134*a*2, 134*a*3, 134*a*4 and 134*a*5, respectively.

In the five horizontal light distribution patterns P1, P2, P3, P4 and P5, lateral diffusion angles thereof have almost the same values. The reason is that a curvature of an upward convex curve is set to be gradually increased from a front edge toward a rear edge for each of the reflecting regions 134*a*1, 134*a*2, 134*a*3, 134*a*4 and 134*a*5.

In the five horizontal light distribution patterns P1, P2, P3, P4 and P5, vertical widths in a central part in a horizontal direction are gradually reduced in order of the horizontal light distribution patterns P1, P2, P3, P4 and P5. The reason is that a size of a light source image formed by the reflected light is gradually increased in order of the reflecting regions 134*a*1, 134*a*2, 134*a*3, 134*a*4 and 134*a*5.

Furthermore, the five horizontal light distribution patterns P1, P2, P3, P4 and P5 are changed from the light distribution patterns extended in the horizontal direction into light distribution patterns which are upward curved gradually in order of the horizontal light distribution patterns P5, P4, P3, P2 and P1. The reason is that an inclination angle to the horizontal direction of the light source image formed by the light reflected from both side portions in a horizontal direction is increased in order of the reflecting regions 134*a*5, 134*a*4, 134*a*3, 134*a*2 and 134*a*1.

In all of the five horizontal light distribution patterns P1, P2, P3, P4 and P5, moreover, upper edges of the central parts in the horizontal direction are positioned on almost the same level as the cutoff line CL1 on the opposing lane side of the basic light distribution pattern P0. The reason is as follows. A downward inclination angle in a vertical plane including the optical axis Ax in the five reflecting regions 134*a*1, 134*a*2, 134*a*3, 134*a*4 and 134*a*5 is set to be gradually reduced in order of the reflecting regions 134*a*1, 134*a*2, 134*a*3, 134*a*4 and 134*a*5. Referring to the light emitted from the light source 14*a* and reflected by each of the reflecting regions 134*a*1, 134*a*2, 134*a*3, 134*a*4 and 134*a*5, consequently, a direction of an upper edge in a bundle of rays is caused to be coincident with a parallel direction with the optical axis Ax. Because the positions of the upper edges of the respective horizontal light distribution patterns P1, P2, P3, P4 and P5 are aligned with each other, it is possible to enhance a contrast of the upper edges of the auxiliary light distribution pattern PC. Consequently, a visibility of the forward road surface of the vehicle can be enhanced still more.

By employing the structure according to the second exemplary embodiment, it is possible to finely control positions in which the reflecting regions 134*a*1, 134*a*2, 134*a*3, 134*a*4 and 134*a*5 are to be formed, thereby forming the auxiliary light distribution pattern PC with higher precision. Consequently, a distance of visibility on both of left and right sides of the forward surface of the vehicle can be enhanced still more.

Next, description will be given to a third exemplary embodiment.

Figure 9:
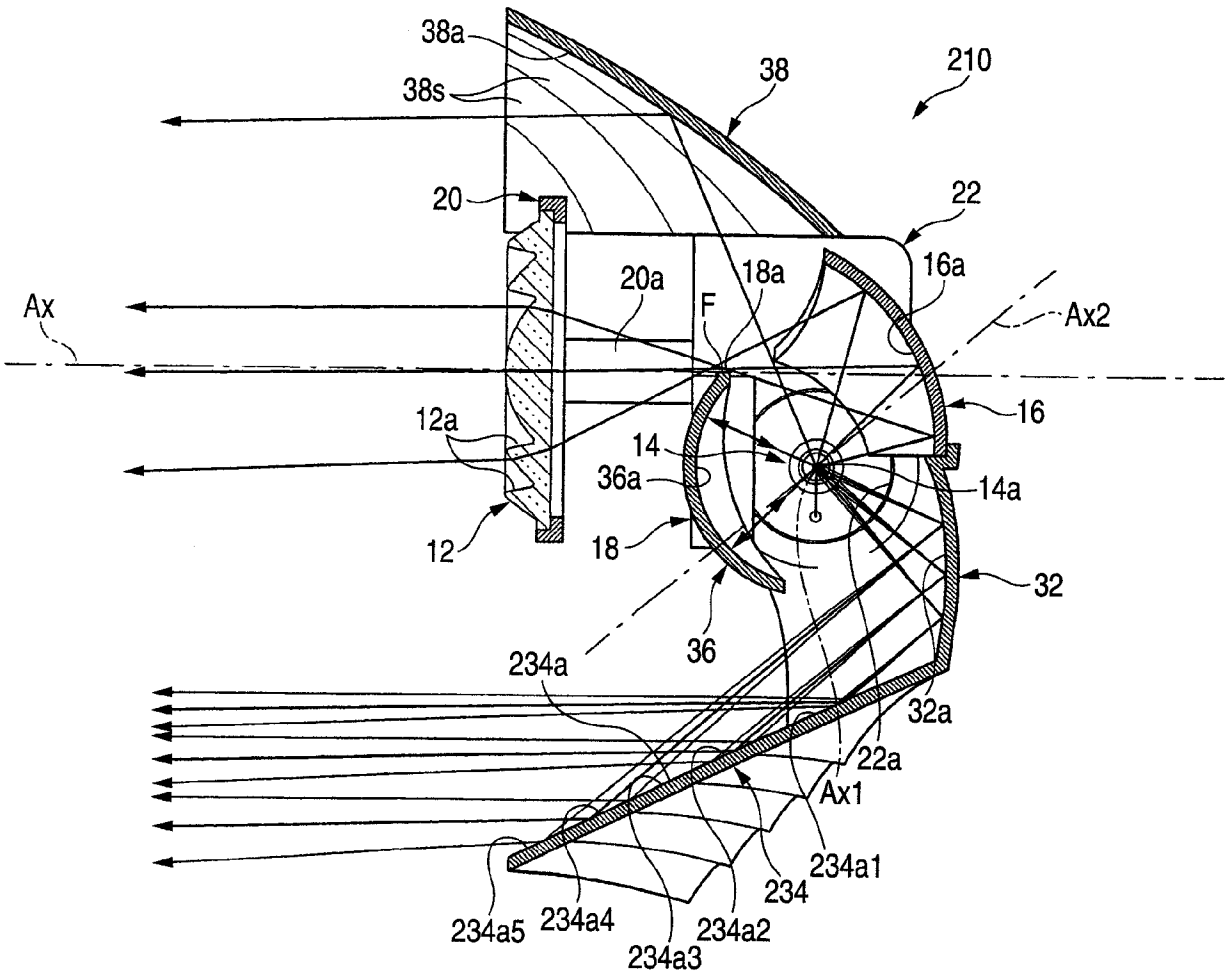
FIG. 9 is a sectional view as illustrating a third exemplary embodiment.

FIG. 9 illustrates a vehicle headlamp 210 according to the third exemplary embodiment.

As shown in FIG. 9, the vehicle headlamp 210 according to the third exemplary embodiment has a basic structure which is similar to that of the vehicle headlamp 110 of the second exemplary embodiment. A structure of a second auxiliary reflector 234 is different from that of the second auxiliary reflector 134 of the second exemplary embodiment.

More specifically, in the second auxiliary reflector 234 according to the third exemplary embodiment, a reflecting surface 234*a* is divided into five reflecting regions 234*a*1, 234*a*2, 234*a*3, 234*a*4 and 234*a*5 in a front-and-rear direction in the same manner as the second auxiliary reflector 134 of the second exemplary embodiment.

Each of the reflecting regions 234*a*1, 234*a*2, 234*a*3, 234*a*4 and 234*a*5 is formed as a horseshoe-shaped region extended to be curved in a rearward direction from a center in a horizontal direction toward both side edges.

In the respective reflecting regions 234*a*1, 234*a*2, 234*a*3, 234*a*4 and 234*a*5, a sectional shape taken along a vertical plane including an optical axis Ax is set to be a straight line downwardly extending in a forward direction at a downward inclination angle which is a little greater than a half of a downward inclination angle of an axis line Ax2 in a similar manner as the reflecting regions 134*a*1, 134*a*2, 134*a*3, 134*a*4 and 134*a*5 according to the first exemplary embodiment. In that case, the downward inclination angle is the smallest in the reflecting region 234*a*1 positioned on a rear end and is the greatest in the reflecting region 234*a*5 positioned on a front end. The downward inclination angles in the three reflecting regions 234*a*2, 234*a*3 and 234*a*4 positioned in a middle are set to be gradually increased in order of the reflecting regions 234*a*2, 234*a*3 and 234*a*4 from a rear side.

According to the structure of the third exemplary embodiment, it is possible to obtain almost the same effects and advantages as those in the second exemplary embodiment, and to enhance the appearance of the second auxiliary reflector 234.

Although the description has been given on the assumption that each of the reflecting surfaces 134*a* and 234*a* of the second auxiliary reflectors 134 and 234 is divided into five reflecting regions in the front-and-rear direction in the second and third exemplary embodiments, it is also possible to employ a structure in which each of the reflecting surfaces is divided into four reflecting regions or less or six reflecting regions or more. If the number of divisions in the front-and-rear direction of the reflecting surface of the second auxiliary reflector is increased infinitely, and the reflecting surface is a curved surface in which a downward inclination angle is gradually increased from a rear edge to a front edge and a direction of an upper edge in a bundle of rays is caused to be coincident with a parallel direction with the optical axis Ax for a light reflected from each point in the reflecting surface of the second auxiliary reflector, a contrast of the upper edge of the auxiliary light distribution pattern PC can be enhanced still more. Also in this case, a curving degree in the front-and-rear direction of the curved surface is very small, and the sectional shape of the reflecting surface of the second auxiliary reflector which is taken along the vertical plane including the optical axis Ax can be maintained to be an almost straight line downwardly extending in a forward direction at a downward inclination angle which is almost a little greater than a half of a downward inclination angle of an axis line Ax2.

Next, description will be given to a fourth exemplary embodiment.

Figure 10:
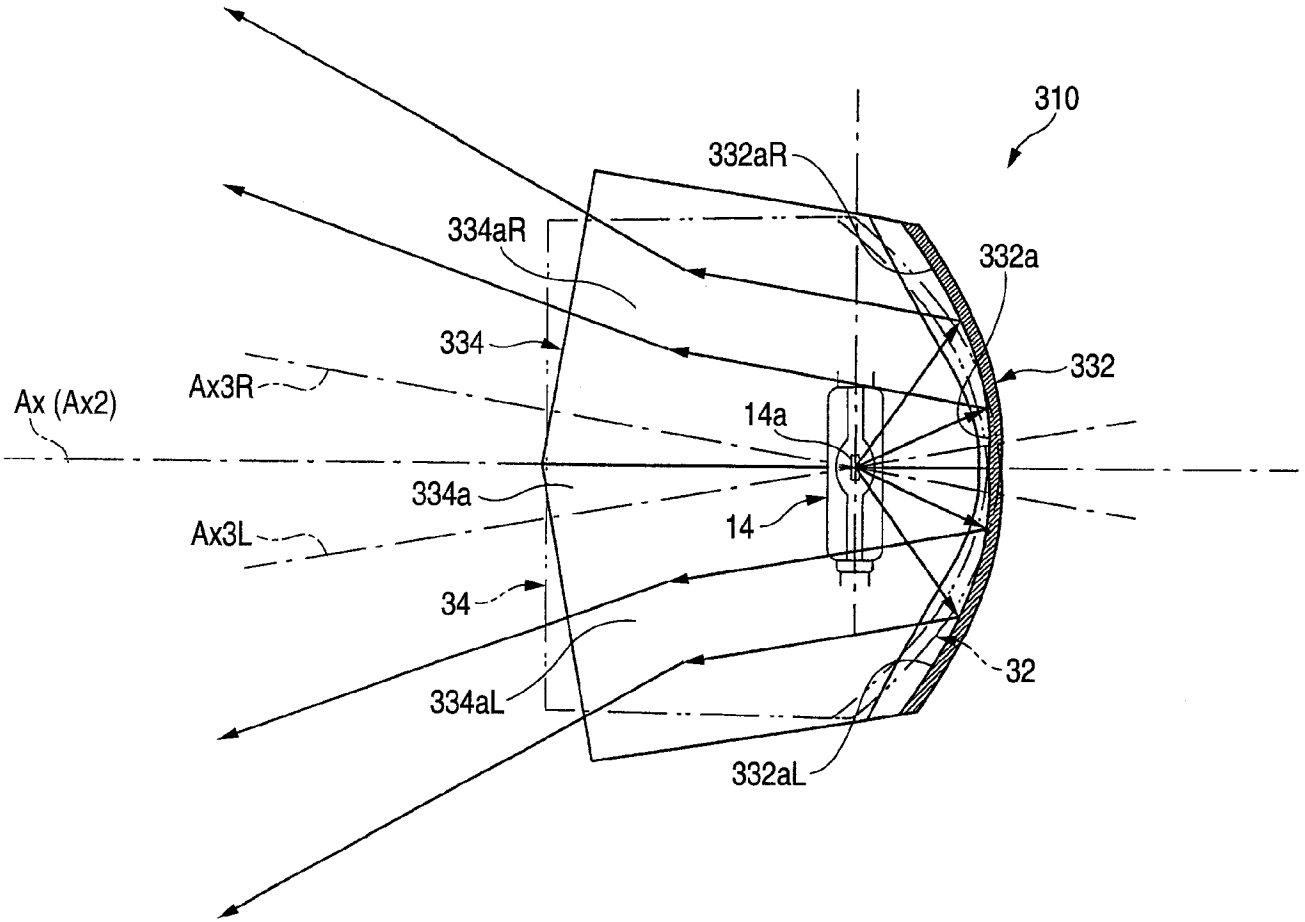
FIG. 10 is a sectional view illustrating a fourth exemplary embodiment.

FIG. 10 illustrates a vehicle headlamp 310 according to the fourth exemplary embodiment.

As shown in FIG. 10, in the vehicle headlamp 310 according to the fourth exemplary embodiment, a basic structure is similar to that of the vehicle headlamp 10 of the first exemplary embodiment, and a structure of a first auxiliary reflector 332 is different from that of the first auxiliary reflector 32 of the first exemplary embodiment so that a structure of a second auxiliary reflector 334 is also different from the second auxiliary reflector 34 of the first exemplary embodiment.

More specifically, in the first auxiliary reflector 332 according to the fourth exemplary embodiment, a reflecting region 332*a*L positioned on a left side of an optical axis Ax in a reflecting surface 332*a* is formed in a shape of a paraboloid of revolution in which an axis line Ax3L obtained by deflecting the axis line Ax2 of the first exemplary embodiment in a leftward direction is set to be a center axis in place of the axis line Ax2, and a reflecting region 332*a*R positioned on a right side of the optical axis Ax is formed in a shape of a paraboloid of revolution in which an axis line Ax3R obtained by deflecting the axis line Ax2 of the first exemplary embodiment in a rightward direction is set to be a center axis in place of the axis line Ax2. Both a leftward deflecting angle of the axis line Ax3L with respect to the axis line Ax2 and a rightward deflecting angle of the axis line Ax3R with respect to the axis line Ax2 are set to have values of approximately 5 to 15 degrees (for example, 10 degrees).

According to the fourth exemplary embodiment, in a reflecting surface 334*a* of the second auxiliary reflector 334, a reflecting region 334*a*L positioned on a left side of the optical axis Ax is set to take a shape obtained by deflecting the reflecting surface 34*a* of the second auxiliary reflector 34 of the first exemplary embodiment in a leftward direction by an equal angle to that of the reflecting region 332*a*L of the first auxiliary reflector 332, and a reflecting region 334*a*R positioned on a right side of the optical axis Ax is set to take a shape obtained by deflecting the reflecting surface 34*a* of the second auxiliary reflector 34 of the first exemplary embodiment by an equal angle to that of the reflecting region 332*a*R of the first auxiliary reflector 332 in a rightward direction.

Figure 11:
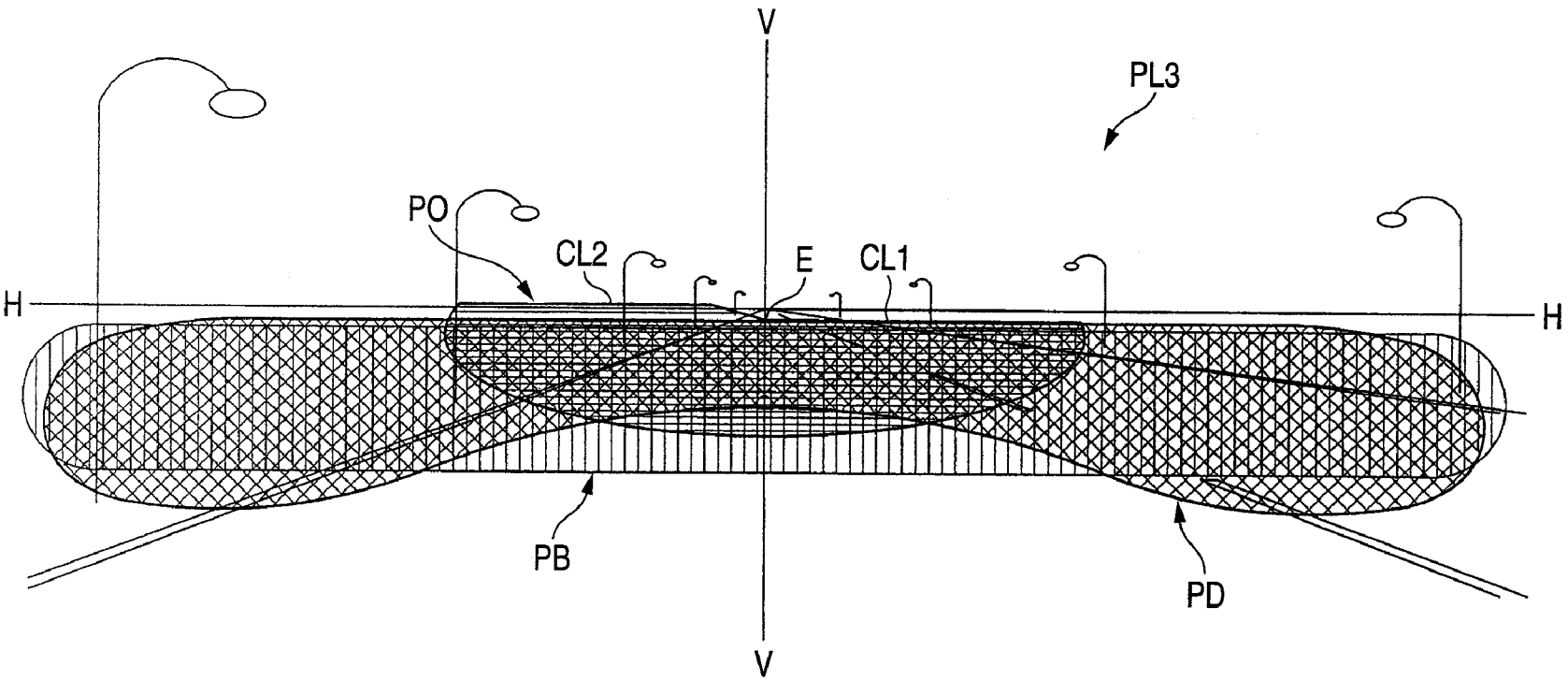
FIG. 11 is a perspective view showing a low beam light distribution pattern formed on the virtual vertical screen by a light irradiated from a vehicle headlamp according to the fourth exemplary embodiment in a forward direction.

FIG. 11 is a perspective view showing a light distribution pattern PL3 for a low beam which is formed on a virtual vertical screen disposed 25 m ahead of a lamp by a light irradiated forward from the vehicle headlamp 310 according to the fourth exemplary embodiment.

The light distribution pattern PL3 for a low beam is formed as a synthetic light distribution pattern of a basic light distribution pattern P0 and two auxiliary light distribution patterns PB and PD.

The basic light distribution pattern P0 and the auxiliary light distribution pattern PB are entirely similar to those of the first exemplary embodiment.

The auxiliary light distribution pattern PD is formed by a light emitted from a light source 14*a* and reflected sequentially by the first auxiliary reflector 332 and the second auxiliary reflector 334 and diffused and irradiated in a forward direction and corresponds to the auxiliary light distribution pattern PA of the first exemplary embodiment.

In the same manner as the auxiliary light distribution pattern PA of the first exemplary embodiment, the auxiliary light distribution pattern PD is formed as a horizontal light distribution pattern and has an upper edge extended in an almost horizontal direction in a position on almost the same level as a cutoff line CL1 on an opposing lane side of the basic light distribution pattern P0 and a lower edge constricted toward an upper side in a central part in a horizontal direction.

The auxiliary light distribution pattern PD is a largely diffused horizontal light distribution pattern taking such a shape that both of left and right ends of the auxiliary light distribution pattern PA of the first exemplary embodiment are extended toward both of left and right sides by approximately 5 to 15 degrees (for example, 10 degrees), respectively. The reason is as follows. The lights reflected by the reflecting region 332*a*L of the first auxiliary reflector 332 and the reflecting region 334*a*L of the second auxiliary reflector 334 are irradiated in a leftward direction by an angular difference between the axis line Ax3L and the axis line Ax2, and the lights reflected by the reflecting region 332*a*R of the first auxiliary reflector 332 and the reflecting region 334*a*R of the second auxiliary reflector 334 are irradiated in a rightward direction by an angular difference between the axis line Ax3R and the axis line Ax2.

By employing the structure according to the fourth exemplary embodiment, it is possible to form the auxiliary light distribution pattern PD as the largely diffused horizontal light distribution pattern. Therefore, it is possible to widely reinforce a brightness on both of the left and right sides of the basic light distribution pattern P0. Consequently, a distance of visibility on both of the left and right sides of a forward road surface of the vehicle can be improved still more and a running safety in a turning operation can be promoted to be enhanced more greatly.

Referring to the auxiliary light distribution pattern PD, brightness in a central part in a horizontal direction is decreased as compared with the auxiliary light distribution pattern PA of the first exemplary embodiment. The brightness in the portion can be sufficiently maintained by the basic light distribution pattern P0.

In the exemplary embodiments, description has been given on the assumption that the light source 14*a* is disposed below the optical axis Ax. As a matter of course, it is also possible to employ a structure in which the light source 14*a* is disposed on the same level as the optical axis Ax.

The numeric values indicated as data in the exemplary embodiments are only illustrative and it is a matter of course that they can be properly set to be different values.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A vehicle headlamp comprising:

a projection lens disposed on an optical axis extending in a longitudinal direction of a vehicle;

a light source disposed on a rear side of a rear focal point of the projection lens;

a reflector which forwardly reflects a light emitted from the light source toward the optical axis;

a shade disposed such that an upper edge of the shade is positioned in the vicinity of the optical axis near the rear focal point, wherein the shade shields a part of the light reflected by the reflector, and forms a cutoff line of a low beam light distribution pattern;

a first auxiliary reflector disposed below the reflector, wherein the first auxiliary reflector downwardly reflects the light emitted from the light source in a forward direction; and a second auxiliary reflector disposed on a front side of the first auxiliary reflector, wherein the second auxiliary reflector forwardly reflects the light reflected by the first auxiliary reflector, wherein the light source is a line light source extending in a width direction of the vehicle, a sectional shape of a reflecting surface of the first auxiliary reflector taken along a vertical plane that is parallel to the optical axis is a shape of a parabola, the parabola having a focal point in the vicinity of the light source and an axis line downwardly extending in the forward direction at a predetermined downward inclination angle with respect to the optical axis, a sectional shape of a reflecting surface of the second auxiliary reflector taken along the vertical plane is a shape of a substantially straight line downwardly extending in the forward direction at a downward inclination angle which is smaller than the predetermined downward inclination angle, and the light emitted from the light source and reflected by the first auxiliary reflector and the second auxiliary reflector is forwardly irradiated as a diffusion light which is diffused in a horizontal direction.

2. The vehicle headlamp according to claim 1, wherein the projection lens is a Fresnel lens.

3. The vehicle headlamp according to claim 1, wherein the reflecting surface of the first auxiliary reflector is formed in a shape of a paraboloid of revolution having a center axis as the axis line downwardly extending in the forward direction, and another sectional shape of the reflecting surface of the second auxiliary reflector taken along a vertical plane that is orthogonal to the optical axis is a shape of an upward convex curve.

4. The vehicle headlamp according to claim 3, wherein a curvature of the upward convex curve is gradually increased from a front edge of the reflecting surface of the second auxiliary reflector toward a rear edge thereof.

5. The vehicle headlamp according to claim 3, wherein the reflecting surface of the second auxiliary reflector includes a plurality of reflecting regions arranged in the longitudinal direction, a sectional shape of each of the reflecting regions taken along the vertical plane that is orthogonal to the optical axis is the shape of the upward convex curve, and a curvature of the upward convex curve is gradually increased from a front edge of each of the reflecting regions toward a rear edge thereof for the reflecting region.

6. The vehicle headlamp according to claim 1, wherein the reflecting surface of the first auxiliary reflector includes a left-side reflecting region on a left side of the optical axis and a right-side reflecting region on a right side of the optical axis, wherein the left-side reflecting region is formed in a shape of a paraboloid of revolution having an axis line obtained by leftwardly deflecting the axis line downwardly extending in the forward direction as a center axis, and the right side reflecting region is formed in a shape of a paraboloid of revolution having an axis line obtained by rightwardly deflecting the axis line downwardly extending in the forward direction as a center axis.

7. The vehicle headlamp according to claim 6, wherein another sectional shape of the reflecting surface of the second auxiliary reflector taken along a vertical plane that is orthogonal to the optical axis is a shape of an upward convex curve.

8. The vehicle headlamp according to claim 7, wherein a curvature of the upward convex curve is gradually increased from a front edge of the reflecting surface of the second auxiliary reflector toward a rear edge thereof.

9. The vehicle headlamp according to claim 7, wherein the reflecting surface of the second auxiliary reflector includes a plurality of reflecting regions arranged in the longitudinal direction, a sectional shape of each of the reflecting regions taken along the vertical plane that is orthogonal to the optical axis is the shape of the upward convex curve, and a curvature of the upward convex curve is gradually increased from a front edge of each of the reflecting regions toward a rear edge thereof for the reflecting region.

10. The vehicle headlamp according to claim 1, wherein the light source is disposed below the optical axis.

11. The vehicle headlamp according to claim 1, wherein the downward inclination angle of the substantially straight line downwardly extending in the forward direction is greater than one-half of the predetermined downward inclination angle.

12. The vehicle headlamp according to claim 1, wherein the first auxiliary reflector reflects the light emitted from the light source as a substantially parallel light, and the second auxiliary reflector regularly reflects the substantially parallel light.

* * * * *